United States Patent [19]

Townsend et al.

[11] Patent Number: 4,846,147

[45] Date of Patent: Jul. 11, 1989

[54] CHIMNEY LINER SYSTEM

[75] Inventors: Donald M. Townsend, Mill Valley; John R. Jacklich, Palo Alto, both of Calif.

[73] Assignee: Simpson Dura Vent Company, Inc., Vacaville, Calif.

[21] Appl. No.: 105,709

[22] Filed: Oct. 5, 1987

[51] Int. Cl.[4] ..... F23J 11/00

[52] U.S. Cl. ..... 126/307 R; 126/500; 98/58; 98/60; 138/149; 138/155; 138/120; 138/109; 138/DIG. 11; 285/47; 285/331; 285/424

[58] Field of Search ..... 98/58, 60, DIG. 7; 110/184; 285/47, 331, 424; 138/120, 109, 155, 110, 149, DIG. 11, 148; 126/124, 123, 307 R, 312

[56] References Cited

U.S. PATENT DOCUMENTS

| | | | |
|---|---|---|---|
| 206,001 | 7/1978 | Campbell | 138/120 |
| 229,620 | 7/1880 | Lynch | 138/148 |
| 289,744 | 12/1883 | Aldrich | 138/148 |
| 447,243 | 2/1891 | Yallera | 138/148 |
| 570,405 | 10/1986 | Jerguson et al. | 138/120 X |
| 570,634 | 11/1896 | Hicks | 138/148 X |
| 2,275,902 | 3/1942 | Hasenburger et al. | 52/219 X |
| 2,372,707 | 4/1945 | Blome | 138/148 X |
| 2,650,112 | 8/1953 | Kinkead | 285/47 |
| 2,713,301 | 7/1955 | McKann | 52/218 X |
| 2,894,537 | 7/1959 | Carr | 285/47 X |
| 3,170,544 | 2/1965 | Kinkead et al. | 285/47 |
| 3,273,600 | 9/1966 | Swan | 138/149 X |
| 3,489,072 | 1/1970 | Secor | 98/58 |
| 3,974,756 | 8/1976 | Long | 98/58 |
| 4,093,193 | 6/1978 | Cassidy et al. | 138/141 X |
| 4,138,987 | 2/1979 | Fromman | 126/307 R X |
| 4,255,483 | 3/1981 | Byrd | 428/245 |
| 4,306,491 | 12/1981 | Reardon, Jr. | 98/60 |
| 4,316,930 | 2/1982 | Stengle, Jr. | 428/266 |
| 4,324,602 | 4/1982 | Davis | 156/71 |
| 4,385,623 | 5/1983 | Jacklich | 126/126 |
| 4,404,992 | 9/1983 | Sasaki et al. | 138/177 X |
| 4,448,219 | 5/1984 | van Hatten | 138/149 |
| 4,633,768 | 1/1987 | Benson | 98/DIG. 7 X |
| 4,664,968 | 5/1987 | Lord | 428/240 |
| 4,667,505 | 5/1987 | Sharp | 138/148 X |

FOREIGN PATENT DOCUMENTS

| | | | |
|---|---|---|---|
| 3136244 | 3/1983 | Fed. Rep. of Germany | 52/218 |
| 3436954 | 5/1985 | Fed. Rep. of Germany | 126/307 R |
| 828106 | 2/1960 | United Kingdom | 52/218 |
| 1463309 | 2/1977 | United Kingdom | 98/60 |

OTHER PUBLICATIONS

Magazine titled: Home Mechanix article entitled: Burning Sensations, pp. 56–58, Sep. 1987 issue.

Magazine titled: Home Mechanix article entitled: Fired With Efficiency, pp. 60–65, Sep. 1987 issue.

Magazine titled: Woodheat/88, "Designing for Warmth", pp. 10–17.

Magazine titled: Woodheat/88, "A new Season for Wood Stoves", pp. 19–25.

Magazine entitled: Woodheat/88 article entitled: New Hope for Old Chimneys, pp. 37–41.

Article entitled: Reline your Chimney, Oct. 1982.

*Primary Examiner*—Larry Jones

*Assistant Examiner*—Carl D. Price

*Attorney, Agent, or Firm*—James R. Cypher

[57] ABSTRACT

A chimney liner system for insertion into a masonry chimney from the top of the chimney down to a stove or fireplace insert. If an offset or a chimney shelf exists in the chimney, a flexible metal pipe member is connected to the bottom end of the chimney liner system. A ceramic heat resistant cloth formed as a sleeve encloses the flexible metal pipe member in selected systems, and in some systems, the sleeve encloses the entire chimney liner system. In some applications, the sleeve may be made from a fiberglass cloth sewn or connected to an inner blanket insulation.

16 Claims, 7 Drawing Sheets

CHIMNEY LINER SYSTEM

BACKGROUND OF THE INVENTION

Installation of a solid fuel stove or fireplace insert and connection to a masonry chimney which was designed for open hearth fires requires that a chimney liner be placed within the chimney. This invention relates to a chimney liner system for masonry chimneys.

Most commercially available chimney liner systems call for the insertion of a metal chimney liner in the center of the masonry chimney and the embedment of the metal liner in some kind of cementitous material.

Such prior art systems are expensive to install, are subject to cracking in the event of creosote fires, and very difficult to remove to make repairs. Specifically, when the metal chimney is completely surrounded with solid concrete, in a very hot fire, there is no room for expansion, and the concrete cracks. Upon cooling, the metal liner often buckles inwardly. If a creosote fire then occurs, the flames move around the buckled steel liner, through the cracks in the concrete to the combustible frame of the house. A house fire is inevitable.

Other chimney liner systems disclose straight metal pipe sections for the straight sections and specially made sheet metal sections for offsets in the chimney or for insertion through the damper area. Such liners require specially made factory pipe sections and careful installation.

Still other chimney liner systems consist of a single elongated flexible metal pipe. Since such flexible sections are single wall and transmit heat quite readily, they require some form of outer insulation to meet code requirements. Some flexible chimney lines are embedded in cemetious material as above described, while others are spirally wrapped in a blanket insulation which is contained by a wire web. Such wrapped pipes are subject to tearing of the insulation on the rough inside walls of the masonry chimney.

Another liner system consists of metal pipes with a preformed insulation member snap locked to the outside of the metal pipes as each section of metal pipe is lowered from the top of the chimney. This system is slow to assemble, the insulation may be damaged in transit, and is subject to slippage relative to the metal pipe liner during and after insulation creating rings of uninsulated areas of the metal liner creating "hot spots" which may cause fires due to overheating of combustible material adjacent the "hot spots".

SUMMARY OF THE INVENTION

The gist of the present invention is to provide a chimney liner system which is less expensive to install than embedded liners, is not subject to cracking in the event of creosote fires, and repair or replacement is relatively inexpensive.

An object of the present invention is to provide a combination straight pipe flue and a flexible pipe section for insertion thought chimney offsets and damper sections which is inexpensive and easy to install.

Another object is to provide a metal liner for a masonry chimney which uses a ceramic cloth formed as an enclosing sleeve as an insulator around the outside of a portion of the metal liner which is easy to install and provides safe operation.

Still another object is to provide a double wall straight pipe section chimney liner with a flexible pipe section which is enclosed in a heat resistant cloth sleeve which provides substantially better heat insulation at a substantially lower cost than present chimney liner systems.

A still further object is to provide a chimney liner system which is enclosed in an abrasion resistant flexible envelope which is resistant to tearing during installation.

A further object is to enclose a metal chimney liner in an insulating cloth sleeve which does not compress like blanket type insulation.

Another object is to provide a layered insulated sleeve which encloses a metal chimney liner in which blanket insulation provides maximum heat insulation and an outer cloth layer provides abrasion resistance to prevent tearing of the blanket insulation.

BRIEF DESCRIPTION

Figure 1:
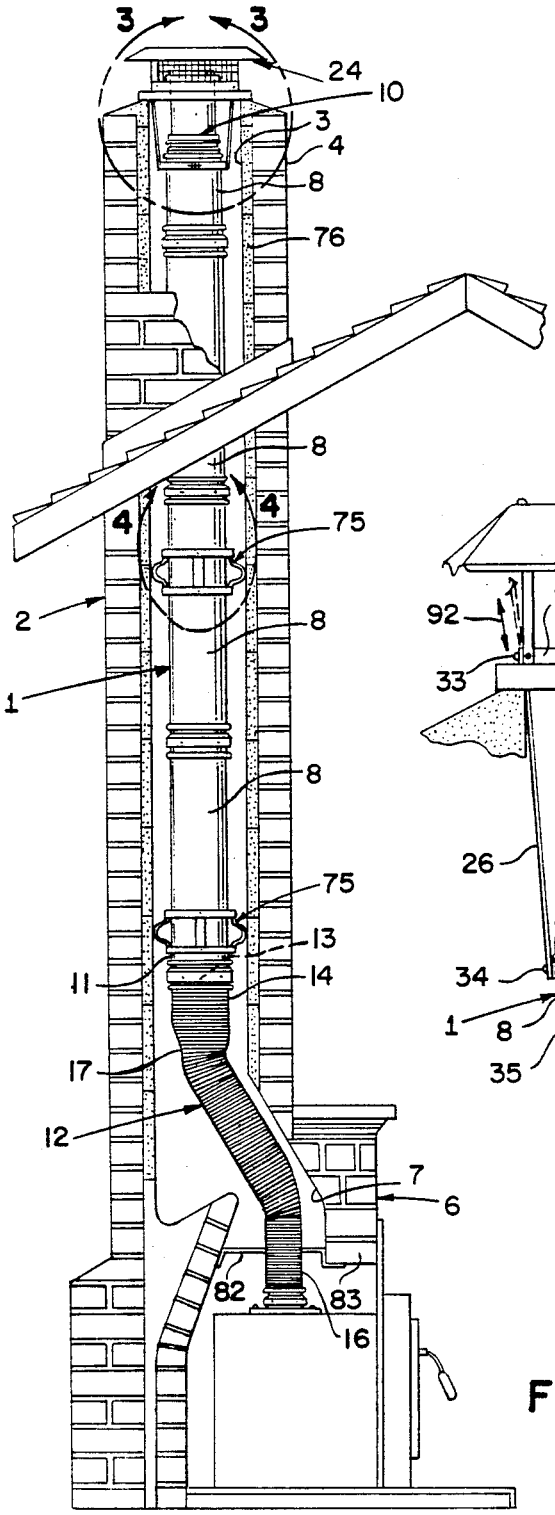
FIG. 1 is a side elevation view of a form of the liner system of the present invention including straight metal pipe sections and a flexible liner section. Portions of the masonry chimney have been removed for illustrating the liner system.
Figure 7:
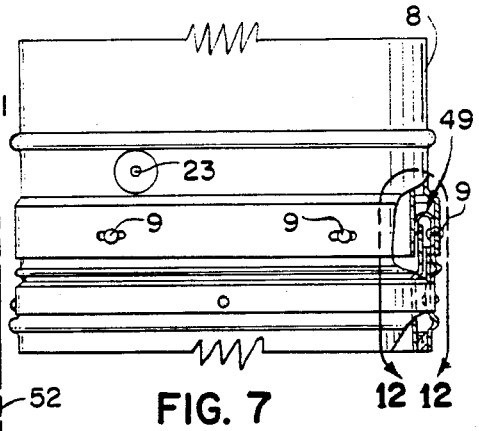
FIG. 7 is a side elevation view with portions cut away of portions of adjoining straight pipe sections interlocked together. The pipes are the same as shown in FIG. 6.
Figure 8:
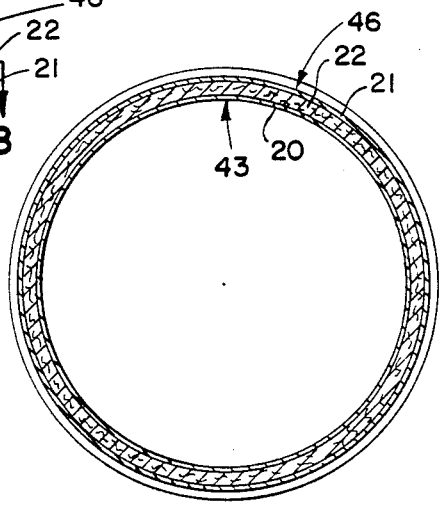
FIG. 8 is a cross sectional view of a straight pipe taken along line 8—8 of FIG. 6.
Figure 9:
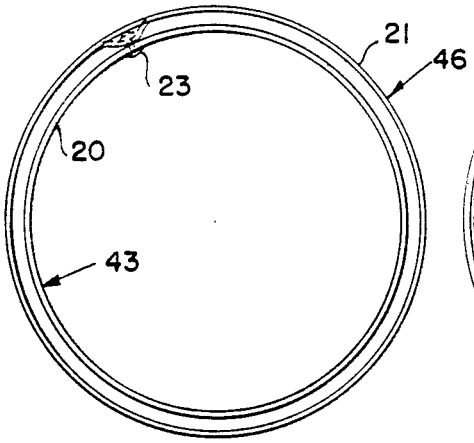
FIG. 9 is an end view of a pipe taken along line 9—9 of FIG. 6.
Figure 10:
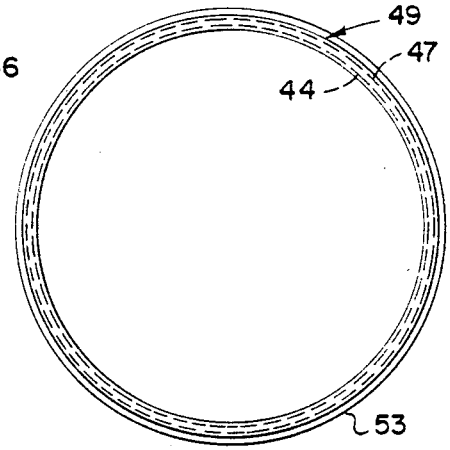
FIG. 10 is an end view of a straight pipe as taken along line 10—10 of FIG. 6.
Figure 11:
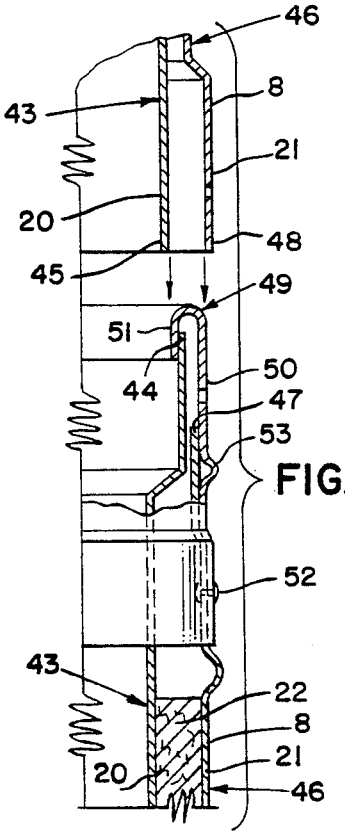
FIG. 11 is an enlarged view of a pipe section taken in the area generally enclosed by lines 11—11 in FIG. 6.
Figure 12:
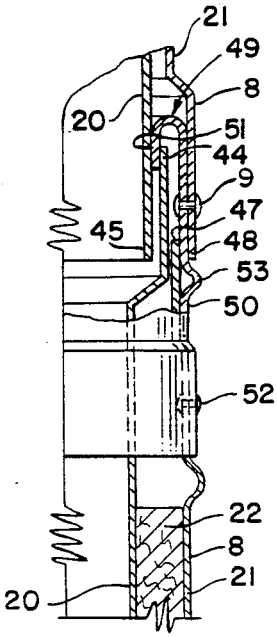
FIG. 12 is an enlarged view of a pipe section taken in the area generally enclosed by lines 12—12 in FIG. 6.

Referring to FIG. 1, the metal chimney liner 1 of the present invention for a pre-existing masonry chimney 2 having an opening 3 at its upper end 4, and either an offset 5 therein (see FIG. 19) or a fireplace 6 with a damper area 7 at its lower end consists briefly of a plurality of rigid straight pipe members 8; pipe member connection means, such as rivets 9 (see FIGS. 7 and 12) connecting the rigid straight pipe members together; the rigid straight pipe members 8 connected together form a straight section of a chimney liner having a top end 10 and a bottom end 11; the top end of the chimney liner is adapted for connection to the upper end of the masonry chimney 2 and extends downwardly through the straight portion of the chimney to an offset section 5 in the masonry chimney or adjacent to a damper area 7 in the fireplace; and a flexible metal member 12 connected to the bottom end of the chimney liner and extending downwardly through the offset portion of the chimney or through the damper area of the fireplace.

Figure 14:
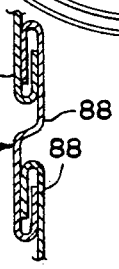
FIG. 14 is a cross section of the flexible metal pipe member shown in FIG. 13 taken generally along lines 14—14.

In most fireplaces, there is a damper area formed with an elongated rectangular area which prevents a circular flexible member from passing through. In the preferred form of the invention, the flexible metal member 12 is formed with a round opening 13 at its upper end 14, a generally obround opening 15 at its other end 16 and a transition section 17 therebetween which changes from round to a generally obround shape. Other shapes are possible with the entire flexible metal member being round, oval or obround. FIG. 14 illustrates the construction of the flexible metal member with individual strip members being bent in the shape shown. Construction is standard and available from a number of manufacturers.

Figure 2:
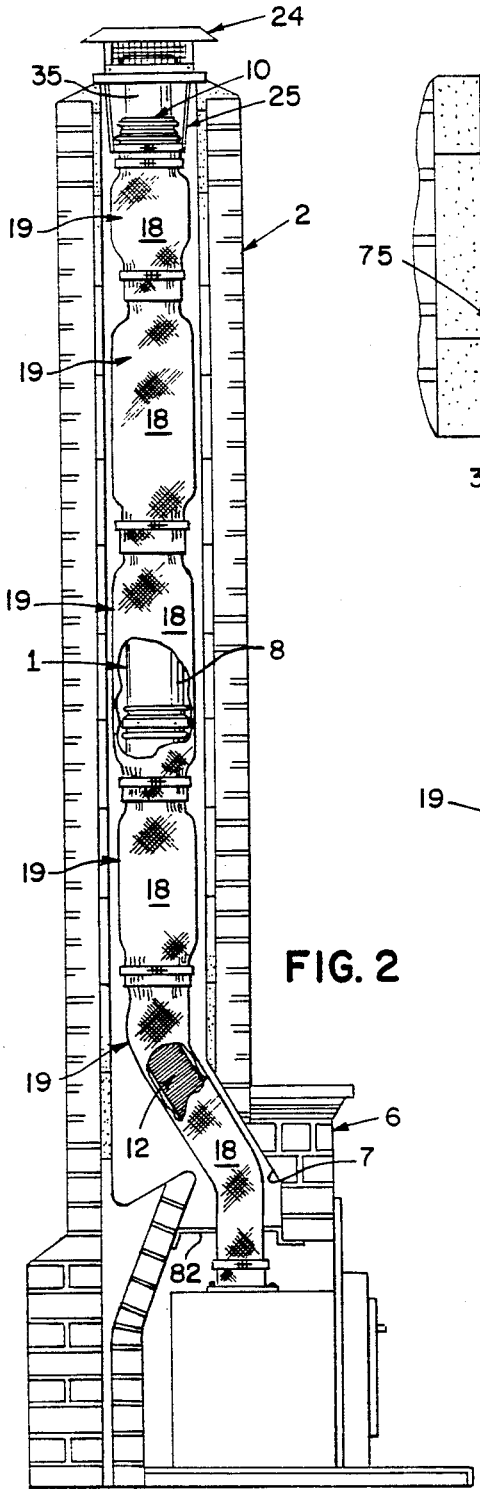
FIG. 2 is a side elevation view of another form of the invention in which straight pipe sections and the flexible section have been enclosed in a ceramic heat resistant cloth sleeve.
Figure 5:
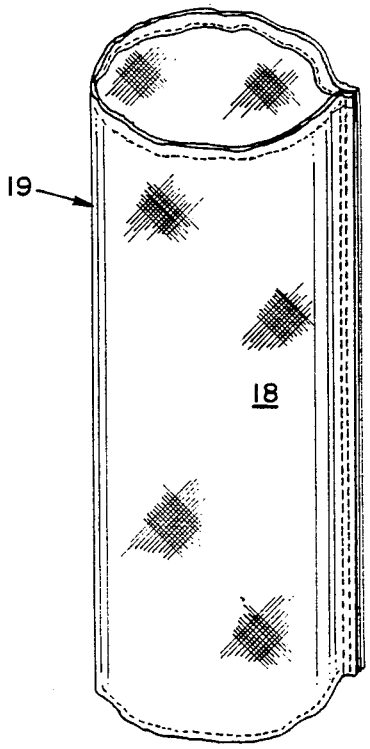
FIG. 5 is a perspective view of one section of the ceramic heat resistant cloth sleeve shown in FIG. 2.
Figure 6:
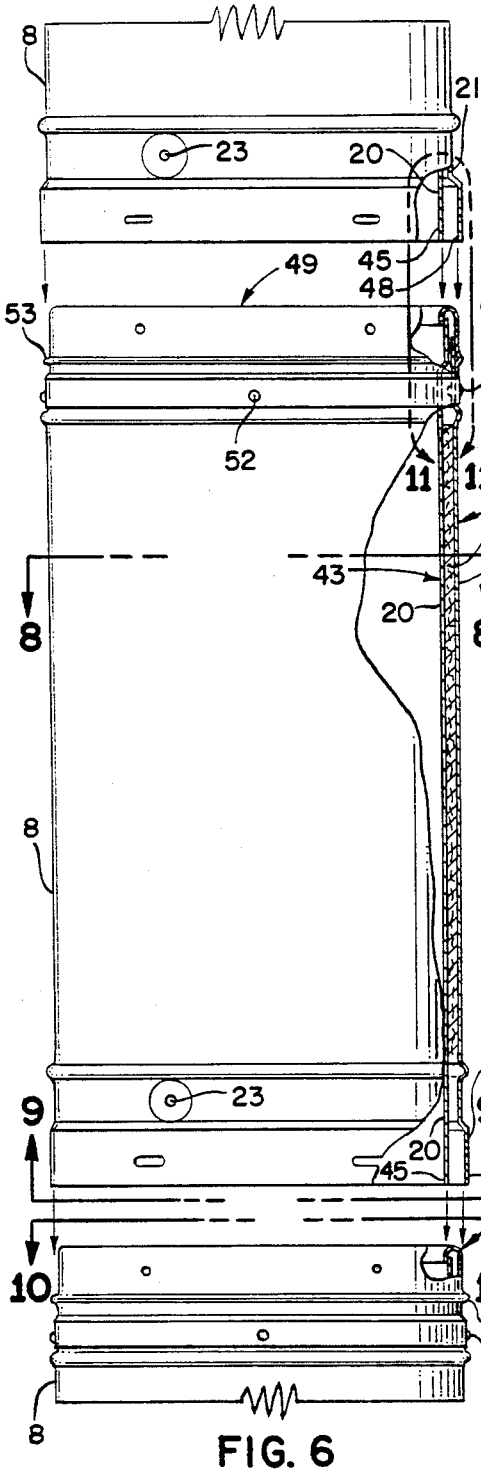
FIG. 6 is a side elevation of a portion of the straight pipe sections of the chimney liner system with portions in cross section for illustrating the construction of the liner. Portions of pipe liners are spaced from a full length pipe section to illustrate the connection between adjacent sections.

Referring to FIGS. 2 and 5, another form of the invention includes a ceramic heat resistant cloth 18 formed as a sleeve 19 encircling the flexible metal member 12.

One ceramic heat resistant cloth which may be used is manufactured and sold by the Haveg division of Ametek of Wilmington, Del. The cloth is known as a thermal barrier fabric sold under the trademark Siltemp and has the chemical name "Amorphous Silica". Specifically, Siltemp has a typical chemical analysis of 97.85% silicon dioxide, 0.80% titanium dioxide, 0.71% aluminum oxide, 0.23% calcium oxide, 0.17% magnesium oxide, 0.16% boric oxide, 0.03% sodium oxide, 0.01% iron oxide, 0.01% zirconium oxide and less than 0.01% each of chromium oxide, copper oxide and nickel oxide. Siltemp contains no asbestos. Siltemp thermal barrier is a family of flexible high-silica textiles with outstanding thermal and flame resistance, and does not melt until temperatures exceed 3000 Degrees F. Siltemp thermal barrier may be obtained with weights of 18 to 36 ounces per square yard and in thicknesses of 0.030 to 0.054 inches.

Heat tests run on the flex material with and without the Siltemp thermal barrier show that with the enclosing sleeve, the flex liner runs substantially hotter, therefore, reducing creosote buildup at lower temperatures. At hotter temperatures, such as would occur in a creosote fire, if one should occur, the Siltemp thermal barrier would reduce the risk of fire hazard.

Referring to FIGS. 6–8, and 11–12, a preferred construction of the rigid straight pipe members 8 is illustrated. Each pipe member is formed with an inner metal wall 20, an outer metal wall 21 spaced radially outwardly therefrom and a sleeve of thermal insulation 22 filling the space formed between the inner and outer metal walls.

The inner and outer metal walls are joined by a pipe wall connection means such as a rivet 23 at a single longitudinal locus. By connecting the inner and outer metal walls at only one locus, the hotter inner wall can extend longitudinally without causing buckling of the cooler outer wall which does not extend longitudinally as far when heated.

In addition, the rigid straight pipe members of the chimney liner system are connected one to the other only by placing a rivet fastener 9 though the outer walls. Thus under heated conditions, elongation of the inner wall of one metal chimney liner is not transmitted to the adjoining metal chimney liner above. On the other hand, elongation of the outer wall of a metal chimney liner is transmitted to the next adjacent outer wall above. The elongation problem is minimized, since the outer wall 21 is thermally shielded by the inner metal wall 20 and the insulation sleeve 22 and thus does not elongate as great a distance as the inner wall.

Preferably a vent cap member 24 is mounted at the upper end 4 of the masonry chimney. A chimney liner connecting means 25 which includes two or more suspension members 26 is connected to the vent cap member 24 and is slidably connected to the top end of the chimney liner 1 preventing downward movement of the chimney liner beyond a selected point but permitting upward movement of the chimney liner. Chimney liner connecting means 25 includes a slip ring 27 having end flanges 28 and 29 adjoined by threaded bolt 30, and tightened by threaded nut 31. The suspension members are joined to a flange 32 on the vent cap 24 by a fastener 33 and to the slip ring 27 by fasteners 34.

A feature of the present metal chimney liner system is the provision of a slip connector pipe liner member 35 connected to the top end of the chimney liner 1 and the vent cap member 24 permitting relative sliding movement between the chimney liner and the slip connector pipe liner member. The slip connector pipe liner member 35 is fixedly connected to the vent cap member 24 by means of "snap-lock" detents 36 formed in the upper portion of the slip connector pipe liner member 35 which interlock with an annular flange 37 formed in cover member 89.

Figure 19:
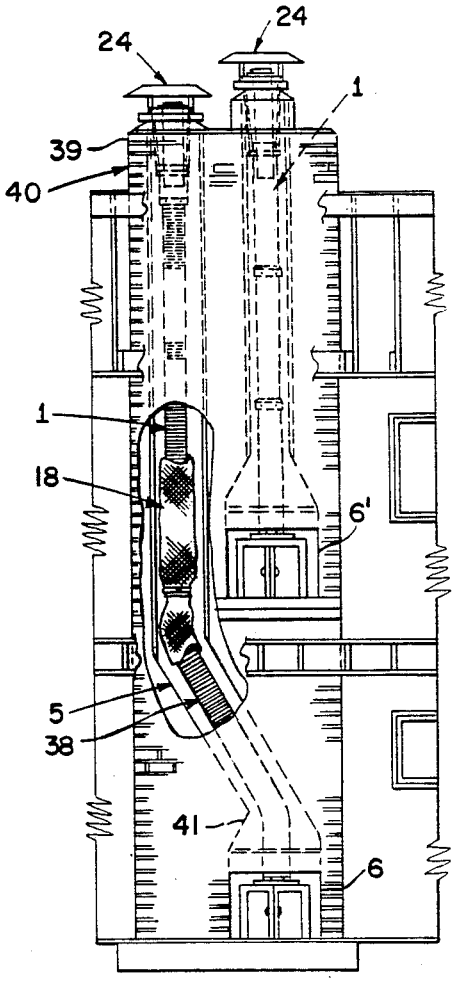
FIG. 19 is a front elevation view of two fireplaces located above one another on separate floors using the same outer masonry chimney but connected to different chimney liners constructed in accordance with the present invention. Portions of the masonry chimney have been removed for purposes of clarification. The solid fuel stove on the lower floor is connected to a flex liner which extends from the stove to a rigid pipe slip section at the top of the chimney. The solid fuel stove on the upper floor is connected to a chimney liner constructed in accordance with the present invention which is composed completely of rigid pipe sections from the stove to the rigid slip section at the top of the chimney.

FIG. 19 illustrates another form of the invention in which a chimney flexible metal pipe liner member 38 is adapted for connection to the upper end 39 of masonry chimney 40 and extends through the lower end 41 of the masonry chimney. In this form of the invention, a ceramic heat resistant cloth 18 formed as a sleeve encircles the flexible pipe and encloses a substantial portion of the length of the chimney flexible metal pipe liner member.

Referring again to FIGS. 6–9, and 11 and 12 the elongated pipe section of the metal liner for a masonry chimney preferably consists of an inner curvilinear elongated metal wall 20 forming an inner open ended tube 43 having a male end 44 and a female end 45; an outer curvilinear elongated metal wall 21 coaxially surrounding the inner curvilinear elongated metal wall 20 and radially spaced therefrom forming an outer open ended tube 46 having a male end 47 and a female end 48; a layer of elongated thermal insulation material 22 placed between and extending substantially the entire length of the inner and outer curvilinear elongated walls; a curvilinear cap ring 49 having an outer and an inner wall 50 and 51 dimensioned to coaxially and closely surround and to extend over and around the male end 44 of the inner curvilinear elongated metal wall 20; a cap ring fastening means 52 joining the curvilinear cap ring only to the outer curvilinear elongated metal wall 21; the female ends 45 and 48 of the inner and outer curvilinear elongated metal walls 20 and 21 being dimensioned and spaced to slidably receive the curvilinear cap ring 49 of an adjoining elongated pipe section; and pipe member connection means 9 joining the cap ring 49 of one elongated pipe section to the female end 48 of an outer curvilinear elongated metal wall 21 only of an adjoining elongated pipe member.

In a preferred form, the curvilinear cap ring 49 is formed with an annular protrusion 53 in the outer wall 50 providing a stop for the female end 48 of the outer wall 21 of one of the adjoining elongated pipe sections.

Figure 18:
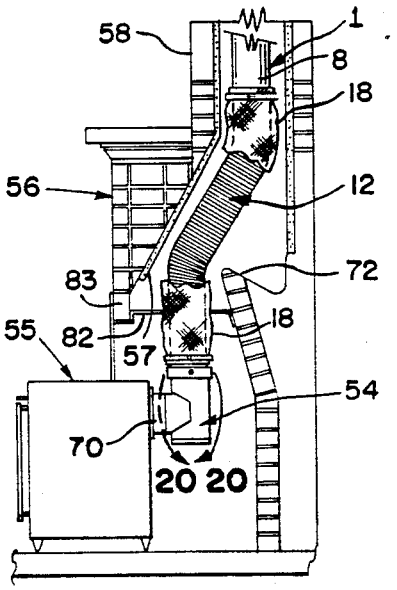
FIG. 18 is a side elevation view of a solid fuel stove with the stove pipe connecting with a tee-connection and the tee-connection connecting with flex pipe section below the damper area of a masonry chimney. Portions of the masonry chimney and fireplace have been removed for purposes of illustration.
Figure 20:
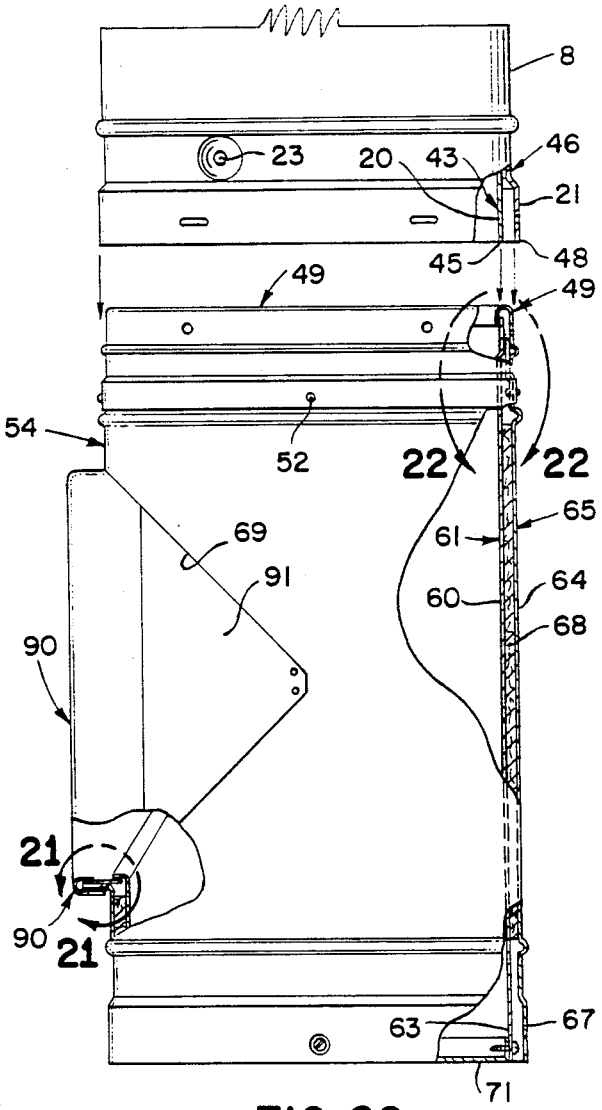
FIG. 20 is a side elevation view of a T-connection drawn on an enlarged scale with portions in cross section for purposes of illustration. A portion of a rigid pipe section is spaced from the top of the tee-connection to illustrate the connection between the two members.
Figure 22:
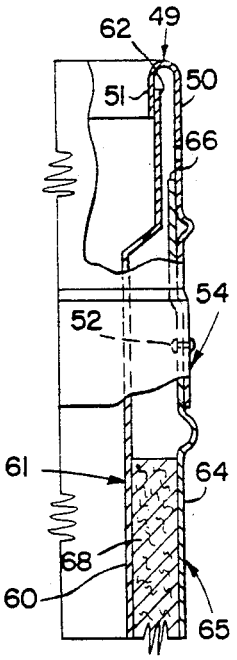
FIG. 22 is a detailed cross section of a portion of the tee-connection shown in FIG. 20 taken generally within lines 22—22.
Figure 21:
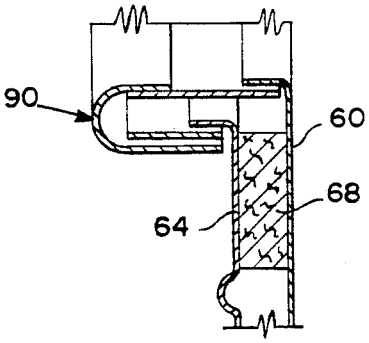
FIG. 21 is a detailed cross section of a portion of the tee-connection shown in FIG. 20 taken generally within lines 21—21.

Referring to FIGS. 20–22, a Tee-connector 54 is illustrated which may be used as illustrated in FIG. 18 in connection with a solid fuel stove 55 in a fire place 56 having a damper area 57 and a masonry chimney 58. The Tee-connector is connected to a metal flexible pipe member 12 which in turn may be connected to a straight pipe member 8.

The tee-connector 54 consists briefly of an inner curvilinear elongated metal wall 60 forming an inner open ended tube 61 having a male end 62 and a female end 63; an outer curvilinear elongated metal wall 64 coaxially surrounding the inner curvilinear elongated metal wall and radially spaced therefrom forming an outer open ended tube 65 having a male end 66 and a female end 67; a layer of elongated thermal insulation material 68 placed between and extending substantially the entire length of the inner and outer curvilinear elongated walls 60 and 64; a curvilinear cap ring 49 having an outer and an inner wall 50 and 51 dimensioned to coaxially and closely surround and to extend over and around the male end 62 of the inner curvilinear elongated metal wall 60; cap ring fastening means 52 joining the curvilinear cap ring 49 only to the outer curvilinear elongated metal wall 64; a curvilinear opening 69 formed in the inner and outer curvilinear metal walls 60 and 64 adapted for receiving a stove pipe 70; and a cover plate 71 covering the female ends 63 and 67 of the inner and outer curvilinear metal walls 60 and 64.

As illustrated in FIG. 21, curvilinear opening 69 is fitted with member 91 forming a round opening and which is encirled with an end cap ring 90.

Operation of the chimney liner

A major cause of chimney related fires is failure to maintain required clearances to masonry materials. It is of the utmost importance that the chimney liner system described in this application be installed only in accordance with instructions provided by the manufacturer of the instant chimney liner. The required clearances are not set forth in this application nor or other important factors such as having a professional installer clean the masonry chimney, install approved appliances as well as the chimney liner system. In summary, this statement is complete for patent filing purposes but should not be used for an actual installation. In addition, local building official or fire department permits may require additional restrictions to meet installation inspection in various areas.

The chimney liner system is designed to work without the existing damper. Thus, the existing damper and in some cases part of the smoke shelf 72 must be removed. Flexible metal pipe member 12 may be round, oval or obround in shape to ease installation.

Figure 3:
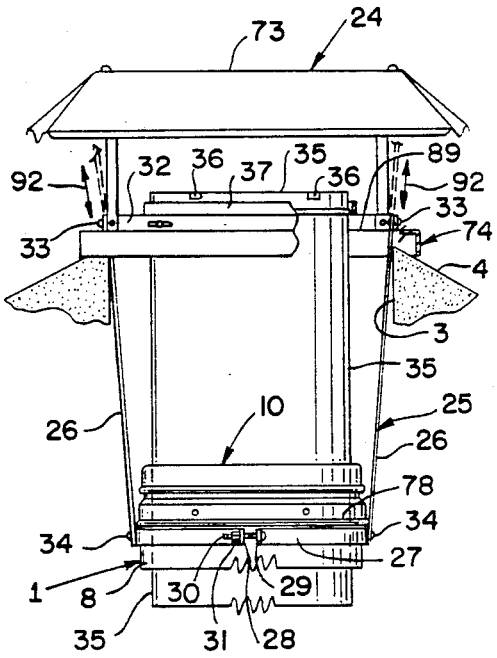
FIG. 3 is a side elevation view of a portion of the chimney and liner system shown within the lines 3—3 of FIG. 1.

The chimney liner system is held in place by the framework of the vent cap member 24 illustrated in FIG. 3 at the top of the chimney and should be designed to support the weight of a relining system up to 50 feet in length.

The vent cap member 24 is assembled by the manufacturer and consists of a top 73, screen (not shown) secondary top 37, frame 74, telescoping slip connector pipe liner member 35, and suspension member 26. The top 73 must be removed to get the frame 74 in place on top of the masonry chimney. The weight of the chimney liner system will hold the frame 74 in place and no other connection is required except for centering screws in frame 74 which are not shown.

Figure 4:
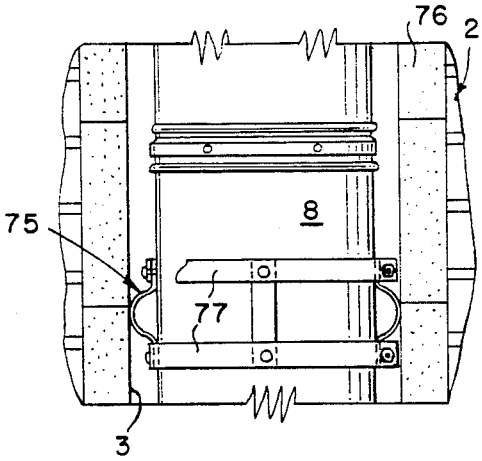
FIG. 4 is a side elevation view of a portion of a chimney and liner system of the present invention as shown within the lines 4—4 of FIG. 1.

All of the straight ppe members 8 and the flexible metal pipe member 12 have male and female ends with four pre-punched holes and slots that line up and are connected with stainless steel pop rivets. No drilling is required and screws should not be used. The ceramic heat resistant cloth 18 formed in the shape of a sleeve 19 as shown in FIGS. 5 and 18 is slipped over the flexible metal pipe member 12 and clamped to it at the top and bottom with simple strap clamps that are secured with a bolt and nut. After connecting the first straight pipe member 8 above the flexible metal pipe member 12, the two members and the cloth sleeve 18 are lowered through the frame 74 and held in place by a special tool not shown. This procedure is repeated until the flexible metal pipe member 12 reaches the smoke shelf area of the fireplace. A shown in FIG. 4, a spacer 75 may be attached to the straight pipe member 8 at various points as needed to space the chimney liner system from the tile liners 76 in the masonry chimney 2. The spacer 75 may consist of a pair of bands 77 which are clamped around the straight pipe members. As the system is being lowered further down, the flexible metal pipe member 12 is bent to fit through the damper area.

Before riveting the last straight pipe membe 8 in place, chimney liner connecting means 25 should be attached just below the bead 78 as shown in FIG. 3. As shown in FIG. 3, suspension members 26 should be bolted to frame 74 and the excess cut off as indicated by the double arrows 92.

In most installations, the ceramic heat resistant cloth in the form of a sleeve 19 need only be placed around the flexible metal pipe member 12 as shown in FIG. 18. If additional insulation is required, however, then additional ceramic heat resistant cloth sleeves 19 are clamped to the straight pipe members 8 as illustrated in FIG. 2.

Figure 13:
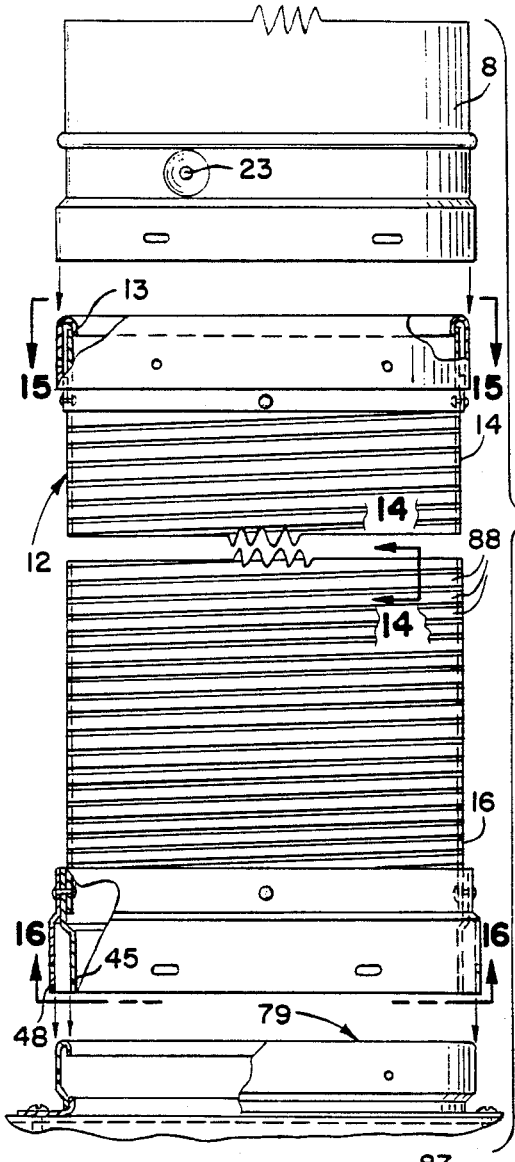
FIG. 13 is a side elevation view of a portion of the chimney liner system of the present invention with portions in cross section illustrating the relationship between the straight pipe sections and the flex section and the relationship of the flex section to the adapter connection to a solid fuel stove.
Figure 15:
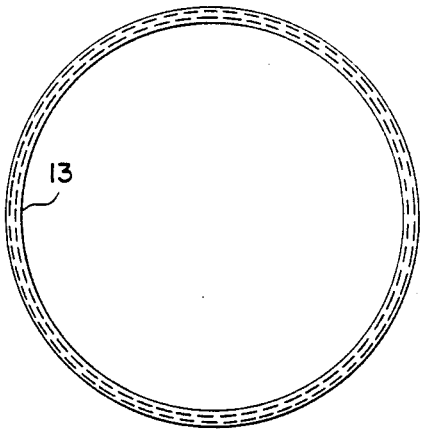
FIG. 15 is an end plan view of the flex section taken generally in the direction of line 15—15 in FIG. 13.
Figure 16A:
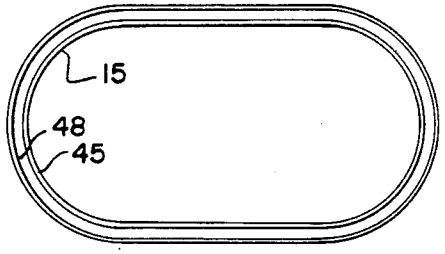
FIG. 16A is an end plan view of the lower end of a first form of the flex section taken generally in the direction of line 16—16 of FIG. 13. In the first form of the invention, the flex section is obround in configuration.
Figure 16B:
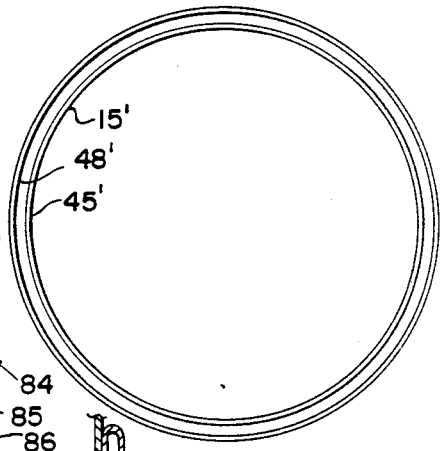
FIG. 16B is an end plan view of the lower end of a second form of the flex section taken generally in the direction of line 16—16 of FIG. 13. In the second form of the invention, the flex section is circular in configuration.

After the liner system is secured, the proper stove top adapter 79 as shown in FIG. 13 should be connected to the fireplace insert or stove. Holes should be drilled and tapped in the top or rear of the stove or self tapping screws may be used. Before attaching permanently, a bead of high temperature mastic should be placed between the stove adapter and the stove.

Finally, the stove adapter or stove should be attached to the chimney liner. If there is insufficient accommodation at the bottom, the slip connector pipe liner member 35 at the top will accommodate an adjustment of 10 inches.

Figure 17:
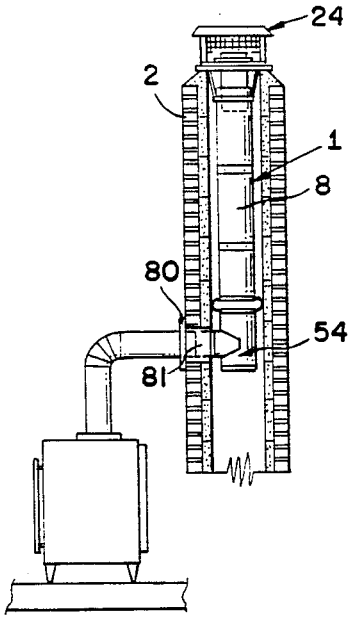
FIG. 17 is a side elevation view of a solid fuel stove with the stove pipe inserted into a T-connection with a chimney liner constructed in accordance with the present invention. Portions of the masonry chimney have been removed for purposes of illustration.

When the chimney liner system is to be attached to the back of a stove as shown in FIG. 18 or through an opening in the chimney as shown in FIG. 17, a Tee-connector 54 is attached to the bottom end of the chimney liner system. As shown in FIG. 17, an adjustable wall thimble 80 is connected to an adjustable sleeve 81 which is connected to the Tee-connector 54.

Since the existing damper must be removed, a damper plate assembly 82 must be placed in the fireplace and may be connected to the lintel 83 as shown in FIGS. 1, 2 and 18. This assembly simply has an opening for the flexible metal pipe member 12 to pass through and otherwise seals off the passage of air up the chimney from the living area.

FIG. 19 illustrates a special situation in which one fire place 6 is placed above another fireplace 6' in a common masonry chimney 40. In this instance a very long chimney flexible metal pipe liner member 38 is used which extends up the entire chimney. Installation is generally as described above.

Alternate sleeve insulator

Figure 23:
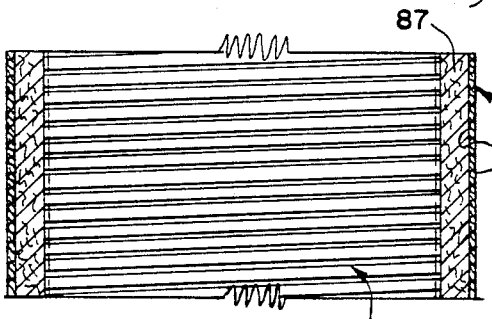
FIG. 23 is a detailed cross section of a portion of still another form of the invention.

Referring to FIG. 23, an alternate sleeve insulator is illustrated which consists of a heat resistant cloth 84 having inner and outer faces 85 and 86 formed as a sleeve encircling the flexible pipe metal pipe member 12; and a layer of blanket insulation 87 formed as a sleeve encircling the flexible metal pipe member and connected to the inner face 86 of the heat resistant cloth.

The alternate sleeve insulator may be also used to cover the entire chimney liner system just as the ceramic heat resistant cloth sleeve 19 was described and illustrated in FIG. 2.

The heat resistant cloth 85 may be one of several woven fiberglass cloths. A preferred form is manufactured by The Carborundum Company of Niagara Falls, New York and sold under the trademark Flexweave 1000 Cloth. Flexweave cloth is non-toxic, will not burn or smolder and is resistant to welding sparks. Flexweave cloth may be used under continuous use limits of 1000 degrees F.

The layer of blanket insulation 87 is also made by The Carborundum Company and is sold under the trademark Fiberfrax Durablanket. Fiberfrax Durablanket insulation has a typical chemical analyis of $Al_2O_3$-44%, $SiO_2$-52%, $Fe_2O_3$-0.85-1.1%, Alkali-0.3%, and leachable chorides less than 10 ppm.

We claim:

1. A chimney liner system for a pre-existing masonry chimney having an upper end and a lower end and said pre-existing masonry chimney having an opening at said upper end and a fireplace with a damper area at said lower end comprising:

a. a plurality of rigid straight metal pipe members for conducting a flow of hot gasses;

b. pipe member connection means connecting said rigid straight metal pipe members together;

c. said rigid straight metal pipe members connected together form a straight section of said chimney liner system having a top end and a bottom end;

d. said top end of said straight section of said chimney liner system is enclosed within said upper end of said masonry chimney and extends downwardly through the straight portion of said masonry chimney to said damper area in said fireplace;

e. a flexible metal pipe member for conducting a flow of hot gasses connected to said bottom end of said straight section of said chimney liner system and extending downwardly through said damper area of said fireplace; and f. a ceramic heat resistant cloth formed as a continuous sleeve loosely and slidably encircling said flexible metal pipe member and enclosing a substantial portion of said length of said flexible metal pipe member for containment of heat during normal operation and containment of hot gasses from said flexible metal pipe member during abnormal operation.

2. A chimney liner system as described in claim 1 comprising:

a. said heat resistant cloth is formed with inner and outer faces; and b. a layer of blanket insulation formed as a continuous sleeve extending coextensively a substantial portion of the length of said ceramic heat resistant cloth sleeve and encircling said flexible metal pipe member and said blanket insulation is connected to said inner face of said heat resistant cloth.

3. A chimney liner system as described in claim 1 comprising:

a. each of said plurality of rigid straight metal pipe members are formed with an inner metal wall, an outer metal wall spaced radially outwardly therefrom and thermal insulation filling the space formed between said inner metal wall and said outer metal wall.

4. A chimney liner system as described in claim 3 comprising:

a. pipe wall connection means attaching said inner and outer metal walls of each of said rigid straight metal pipe members at a single longitudinal locus;

b. said pipe wall connecting means connecting said rigid straight metal pipe members together is limited to connecting only said outer metal walls together thereby permitting relatively different longitudinal expansion of said hot inner metal walls and said relatively cooler outer metal walls;

c. a vent cap member mounted at the upper end of said masonry chimney;

d. chimney liner connecting means including a suspension member connected to said vent cap member and slidably connected to said top end of said straight section of said chimney liner system preventing downward movement of said straight section of said chimney liner system beyond a selected point but permitting upward movement of said straight section of said chimney liner system; and e. a slip connector pipe liner member connected to said top end of said straight section of said chimney liner system and said vent cap member permitting relative sliding movement between said straight section of said chimney liner system and said slip connector pipe liner member.

5. A chimney liner system for a pre-existing masonry chimney having an upper end and a lower end and said pre-existing masonry chimney having an opening at said upper end and an opening at said lower end comprising:

a. a metal pipe having an upper end and a lower end mounted in said pre-existing masonry chimney; and b. a plurality of ceramic heat resistant cloths each formed as a continuous sleeve loosely and slidably encircling and mounted on said metal pipe in overlapped contiguous relation and enclosing a portion of said metal pipe.

6. In a chimney liner system for a masonry chimney having an upper end and a lower end and said masonry chimney is formed with an opening at said upper end and an opening at said lower end and said chimney liner system consisting of adjoining elongated pipe sections, one of said adjoining elongated pipe sections comprising:

a. an inner curvilinear elongated metal wall forming an inner open ended tube having a male end and a female end;

b. an outer curvilinear elongated metal wall coaxially surrounding said inner curvilinear elongated metal wall and radially spaced therefrom forming an outer open ended tube having a male end and a female end;

c. a layer of elongated thermal insulation material placed between and extending substantially the entire length of said inner and outer curvilinear elongated walls;

d. a curvilinear cap ring having an outer and an inner wall dimensioned to coaxially and closely surround and to extend over and around said male end of said inner curvilinear elongated metal wall;

e. cap ring fastening means joining said curvilinear cap ring only to said outer curvilinear elongated metal wall;

f. said female ends of said inner and outer curvilinear elongated metal walls being dimensioned and spaced to slidably receive said curvilinear cap ring of one of said adjoining elongated pipe sections;

g. pipe member connection means joining said cap ring of one elongated pipe section to the female end of an outer curvilinear elongated metal wall only of one of said adjoining elongated pipe members; and h. a ceramic heat resistant cloth formed as a continuous sleeve loosely and slidably encircling said elongated pipe sections and enclosing a substantial portion of said length of said chimney liner system for said masonry chimney.

7. In a chimney liner system for a masonry chimney wherein said elongated pipe section described in claim 6 includes:

a. said curvilinear cap ring is formed with an annular protrusion in said outer wall providing a stop for said female end of said outer wall of one of said adjoining elongated pipe sections.

8. In a chimney liner system for a masonry chimney as described in claim 7 including, a Tee-connector connected to said lower end of said metal pipe comprising:

a. an inner curvilinear elongated metal wall forming an inner open ended tube having a male end and a female end;

b. an outer curvilinear elongated metal wall coaxially surrounding said inner curvilinear elongated metal wall and radially spaced therefrom forming an outer open ended tube having a male end and a female end;

c. a layer of elongated thermal insulation material placed between and extending substantially the entire length of said inner and outer curvilinear elongated walls;

d. a curvilinear cap ring having an outer and an inner wall dimensioned to coaxially and closely surround and to extend over and around said male end of said inner curvilinear elongated metal wall;

e. cap ring fastening means joining said curvilinear cap ring only to said outer curvilinear elongated metal wall;

f. a curvilinear opening formed in said inner and outer curvilinear metal walls adapted for receiving a stove pipe; and g. a cover plate covering said female ends of said inner and outer curvilinear metal walls.

9. A chimney liner system for a pre-existing masonry chimney having an upper end and a lower end and said pre-existing masonry chimney in formed with an opening at its upper end, and an opening at its lower end, comprising:

a. a chimney flexible metal pipe liner member mounted in said masonry chimney and extending substantially the length of said masonry chimney from said upper end to said lower end; and b. a ceramic heat resistant cloth formed as a continuous sleeve loosely and slidably encircling and enclosing a substantial portion of the length of said chimney flexible metal pipe liner member.

10. A chimney liner system for a pre-existing masonry chimney having an upper end and a lower end and said pre-existing masonry chimney having an opening at said upper end and an opening at said lower end comprising:

a. a metal pipe chimney liner having an upper end and a lower end;

b. chimney liner connecting means connecting said upper end of said metal pipe to said upper end of said masonry chimney; and c. a heat resistant cloth having inner and outer faces and formed as a continuous sleeve loosely and slidably encircling said metal pipe and enclosing a substantial portion of the length of said metal pipe; and;

d. a layer of blanket insulation formed as a sleeve encircling said metal pipe chimney liner and connected to said inner face of said heat resistant cloth.

11. A chimney liner system for a pre-existing masonry chimney having an upper end and a lower end and said pre-existing masonry chimney having an opening at said upper end and an opening at said lower end comprising:

a. a plurality of rigid, straight, metal pipe liner members having a combined length extending from said masonry chimney opening at the upper end of said masonry chimney to said masonry opening at the lower end of said masonry chimney; and b. a ceramic heat resistant cloth formed as a continuous sleeve loosely and slidably encircling a substantial number of said plurality of rigid, straight, metal pipe liner members.

12. A chimney liner system for a pre-existing masonry chimney having an upper end and a lower end and said pre-existing masonry chimney opening having an at said upper end and opening at said lower end comprising:

a. a plurality of rigid, straight, metal pipe liner members having a combined length extending from said masonry chimney opening at the upper end of said masonry chimney to said masonry opening at the lower end of said masonry chimney; and b. a plurality of ceramic heat resistant cloth continuous sleeves joined to each other and loosely and slidably encircling a substantial number of said plurality of rigid, straight, metal pipe liner members.

13. A method of installing a chimney liner system in a masonry chimney having a top masonry chimney opening and a masonry chimney damper opening at the lower end of said masonry chimney comprising:

a. selecting a length of flexible metal pipe liner having upper and lower ends;

b. selecting and forming a thermal resistant cloth into an elongated sleeve enveloping a substantial portion of the length of said flexible metal pipe liner and inserting said thermal resistant cloth sleeve and said flexible metal piper liner into said top opening of said masonry chimney;

c. selecting and connecting a straight section of a metal pipe liner section to said upper end of said flexible metal pipe liner;

d. connecting said elongated sleeve to either said flexible metal pipe liner or said straight section of said metal pipe liner;

e. lowering said flexible metal pipe liner through said masonry chimney top opening into said masonry chimney;

f. repeating said selecting, enveloping, connecting and lowering additional straight sections of metal pipe liners until said flexible metal piper liner section is inserted through said bottom opening in said masonry chimney;

g. inserting an elongated slip connector pipe liner member into the uppermost of said straight sections of metal pipe liner;

h. selecting and attaching a vent cap member to the top of said masonry chimney; and i. attaching the upper end of a slip strap connector to said vent cap member and attaching the lower end to said uppermost of said straight sections of metal pipe liner so as to prevent lowering of said metal chimney pipe liner, but permitting upward movement of said metal chimney pipe liner.

14. A method of installing a chimney liner system in a masonry chimney having an upper end and a lower end and said pre-existing masonry chimney having an opening at said upper end and an opening at said lower end comprising:

a. selecting a flexible metal pipe liner having upper and lower ends and having a length dimensioned for extending substantially the length of said masonry chimney;

b. selecting and forming a thermal resistant cloth into a continuous elongated sleeve for loosely and slidably enveloping a substantial portion of the length of said flexible metal pipe liner and inserting said thermal resistant cloth sleeve and said flexible metal pipe liner into said opening in said upper end of said masonry chimney;

c. connecting said elongated sleeve to said flexible metal pipe liner;

d. lowering said flexible metal pipe liner through said opening in said upper end of said masonry chimney until said flexible metal pipe liner is inserted through said opening in said lower end of said masonry chimney; and e. attaching one of said ends of said flexible metal pipe liner in fixed relation to said masonry chimney.

15. A method of installing a chimney line system in a masonry chimney having an upper end and a lower end and said masonry chimney having a top opening at said upper end and a masonry chimney damper section formed with an opening at said lower end comprising:

a. selecting a flexible metal pipe liner having upper and lower ends and having a length dimensioned for extending at least the length of said masonry chimney damper section;

b. selecting and connecting a straight section of a metal pipe liner section to said upper end of said flexible metal pipe liner;

c. lowering said flexible and straight section of metal pipe liner through said top opening in said masonry chimney:

d. repeating said selecting, connecting and lowering additional straight sections of metal pipe liners until said flexible metal pipe liner section is inserted through said masonry chimney damper section and said opening in said lower end of said masonry chimney;

e. selecting and forming a thermal resistant cloth into a continuous elongated sleeve having a length for loosely and slidably enveloping a substantial portion of the length of said flexible and straight sections of metal pipe liner;

f. pulling said elongated sleeve over the upper end of the uppermost straight section of metal pipe and continuing to pull said sleeve until a substantial portion of said straight and flexible metal chimney pipe liner is enclosed within said elongated sleeve; and g. attaching one of said ends of said metal pipe liner in fixed relation to said masonry chimney.

16. A chimney liner system as in claims 1, 5, 9, 10, 11 or 12 in which:

a. said ceramic heat resistant cloth formed as a continuous sleeve is constructed to form a flame barrier.

* * * * *

UNITED STATES PATENT AND TRADEMARK OFFICE

CERTIFICATE OF CORRECTION

PATENT NO. : 4,846,147

DATED : July 11, 1989

INVENTOR(S) : Donald M. Townsend etal

It is certified that error appears in the above-identified patent and that said Letters Patent is hereby corrected as shown below:

Column 6, line 32, change the word "or" to ---are---

Column 7, line 7, change the word "A" to ---As---

Column 7, line 15, change the word "membe" to ---member---

Column 10, line 46, change the word "in" to --- is---

Column 11, line 21, delete the word "opening"

Column 11, line 21, after the word "an" insert ---opening---

Column 11, line 22, after the words "end and" insert ---an---

Column 11, line 25, change the word "the" to ---said---

Column 11, line 26, change the word "the" to ---said---

Column 12, line 29, change the word "line" to ---liner---

Signed and Sealed this

Twenty-sixth Day of June, 1990

*Attest:*

HARRY F. MANBECK, JR.

*Attesting Officer*

*Commissioner of Patents and Trademarks*